US006453616B1

(12) United States Patent
Wright

(10) Patent No.: US 6,453,616 B1
(45) Date of Patent: Sep. 24, 2002

(54) ASTRAGAL

(75) Inventor: James Richard Wright, Valrico, FL (US)

(73) Assignee: Genesis Architectural Products, Inc., Valrico, FL (US)

( * ) Notice: Subject to any disclaimer, the term of this patent is extended or adjusted under 35 U.S.C. 154(b) by 0 days.

(21) Appl. No.: 09/820,032

(22) Filed: Mar. 28, 2001

(51) Int. Cl.[7] ..... E05C 7/04
(52) U.S. Cl. ..... 49/365; 49/368
(58) Field of Search ..... 49/365–368, 116

(56) References Cited

U.S. PATENT DOCUMENTS

| | | | | |
|---|---|---|---|---|
| 3,649,060 A | | 3/1972 | Ruff | 292/42 |
| 3,653,155 A | | 4/1972 | De Brunyn, Jr. et al. | 49/313 |
| 3,806,175 A | | 4/1974 | Van Herpen | 292/147 |
| 3,944,266 A | * | 3/1976 | Weaver | 292/145 |
| 4,052,819 A | | 10/1977 | Beischel et al. | 49/368 |
| 4,058,332 A | | 11/1977 | Difazio | 292/147 |
| 4,429,493 A | | 2/1984 | St. Aubin | 49/367 |
| 4,573,287 A | * | 3/1986 | Hagemeyer et al. | 49/381 |
| 4,644,696 A | | 2/1987 | Bursk | 49/367 |
| 5,335,450 A | | 8/1994 | Procton | 49/368 |
| 5,675,947 A | | 10/1997 | Yane | 52/207 |
| 5,822,923 A | | 10/1998 | Governale | 49/365 |
| 5,857,291 A | | 1/1999 | Headrick | 49/368 |

FOREIGN PATENT DOCUMENTS

| | | | |
|---|---|---|---|
| CH | 0558465 | 5/1972 | 49/351 |

* cited by examiner

*Primary Examiner*—Robert W. Gibson, Jr.
(74) *Attorney, Agent, or Firm*—Pettis & Van Royen, PA

(57) ABSTRACT

An astragal used with exterior double door installations, such as french doors. When attached to the edge of the generally inactive door, the astragal provides a door stop for the active door, a seal to prevent intrusion of water, and a lock for the inactive door. The invention particularly pertains to extruded metal astragals capable of increasing the resistance of the double door system to high wind conditions. The astragal comprises a longitudinally extending base member that has at least one longitudinally extending channel and a pair of spaced apart outwardly extending legs. At least one bolt is slidably inserted in the channel adjacent to one of the first and second ends of the channel. The astragal is attached to the door by at least one cleat whose spaced apart arms engage the legs of the base member providing resistance to the astragal rocking in relation to the door edge when the doors are under wind forces.

9 Claims, 8 Drawing Sheets

ASTRAGAL

BACKGROUND OF THE INVENTION

1. Field of the Invention

The present invention relates to an improved astragal used with exterior double door installations, such as french doors. When attached to the edge of the generally inactive door, the astragal provides a door stop for the active door, a seal to prevent intrusion of water, and a means for locking the inactive door to the adjacent door header and door sill. The invention particularly pertains to extruded metal astragals capable of increasing the resistance of the double door system to failure under high wind conditions.

2. Description of the Prior Art

Double doors constructed in the exterior walls of homes and businesses have become an increasingly popular means for optionally enlarging openings between the interior and exterior of structures. However, double doors provide a much greater risk to failure during high wind conditions than standard single doors. Not only do the double doors provide a large area of construction that is weaker than the structure's walls, they have a central separation between the double doors with only a door latch and perhaps a deadbolt to maintain closure. The double doors flex inwardly and outwardly during high winds causing them to fail long before the building itself would have failed, but failure of the doors hastens the overall failure of the building.

Astragals have long been used to seal the separation between the double doors and at the same time increase the rigidity of the doors by providing a vertical member that is attached to one of the doors, normally the least active door. Without a means for locking one of the doors in a closed position, both doors may be easily forced opened by pulling or pushing on them, causing them to bow and flex, until a standard door latch and dead bolt are released from their retainers releasing the doors. Many astragals provide slidable bolts to lock the door to which it is attached in a closed position, allowing the other door to open and close freely. The astragal has an upper bolt that is extendable upwardly into the door frame header and a lower bolt that is extendable downwardly into the door frame sill, locking the door in the closed position. The astragal usually also provides a door stop to prevent the free door from pivoting past the closed position.

Examples of astragals are shown in U.S. Pat. No. 5,335,450, which was issued to Brad I. Procton, U.S. Pat. No. 4,058,332, which was issued to Joseph DiFazio, U.S. Pat. No. 3,649,060 which was issued to Robert Ruff, and U.S. Pat. No. 4,429,493 which was issued to William St. Aubin. Procton '450 discloses an astragal constructed from a combination of wood and an aluminum extrusion. The means for attachment of the astragal to the door comprises a screw threaded through the wooden portion of the astragal and into the door proximal to one side of the door. With wind forces striking a door held by such an astragal, the astragal will fail when the screw is torn through the thin layer of wood covering the screws by shear forces.

The patents to Ruff '060, St. Aubin '493 and DiFazio '332, each disclose an extruded astragal attached to a metal clad door by screws threaded through the center of the astragal and into the center of the doors. Pressure from high winds cause the double doors to flex inwardly and outwardly. This movement of the doors will cause the the astragal to pivot about the screw center line along the length of the door. This will cause the astragal to pull free from the door and the double doors to open. In addition, each of these doors has a single bolt extending from the top of the door and a single bolt extending from the bottom of the door, so that as the doors bow inwardly and outwardly from the wind pressure, the single bolt at the top of the door will be pulled free from the keeper that is attached to the header and the single bolt at the bottom of the door will be pulled free from the keeper that is attached to the sill. The bolt in Ruff '060 is rectangular, with its longer axis extending perpendicular to the door frame, to increase the resistance to high winds, but the width of the longer axis of the bolt is much smaller than the thickness of the door, and therefore does not gain the full benefit of resistance to bowing of the door.

Not withstanding the existence of such prior art astragals, it remains clear that there is a need for an improved astragal capable of withstanding high wind forces.

SUMMARY OF THE INVENTION

The present invention relates to astragals that are used to seal and strengthen exterior double door installations in order to improve the doors resistance to forces applied by wind storm or by man. Double doors are particularly vulnerable to storm pressures and break-ins as, other than windows, double doors are the weakest points in the perimeter of buildings. The astragal of this invention is mounted to a double door assembly that includes an active door and a generally inactive door, each of which are pivotally mounted to a door frame. When the doors are closed the vertical edges of the doors are adjacent to one another and the doors overlie the sill of the door frame.

Most simply stated, the improved astragal of this invention comprises a longitudinally extending base member that has a first end and a second end, a first side and a second side, a front face and a rear face, and at least one longitudinally extending channel that is formed as a part of the base member. The channel itself has a first end and a second end. At least one bolt is slidably inserted in the channel adjacent to one of the first and second ends of the channel so that the bolt may be selectively movable between an extended position, where the bolt secures the generally inactive door, and a retracted position, which frees the door for pivoting. The astragal further provides a means for selectively locking the bolt in the channel in a retracted or extended position.

A longitudinally extending shield member and door stop is attached to the base member at generally right angles thereto to form a T-shaped cross-section. The shield member and door stop extends longitudinally substantially the length of the base member so that when the base member, or stem of the T-shaped member, is inserted between the double doors and is attached to the generally inactive door, the shield member and door stop provides sealing protection over the gap between the double doors and provides a door stop for the active door. The doors and the astragal may be arranged within the door frame so that doors swing inwardly or outwardly. If the doors swing inwardly the astragal will be attached so that the shield member and door stop will lie on the exterior side of the doors, and when the doors swing outwardly the shield member and door stop will lie on the interior side of the doors.

A first leg is attached proximal to the first side of the base member by its first end and its second end extends outwardly therefrom so that a portion of the first leg that is proximal to the second end of the leg has a surface that faces inwardly toward the base member. A second leg has a first end that is attached proximal to the second side of the base member and a second end that extends outwardly therefrom so that a portion of the second leg that is proximal to the second end of the second leg has an inwardly facing surface.

The astragal further comprises a longitudinally extending mounting cleat which is comprised of a body having a first end and a second end, a first side and a second side, a first arm extending outwardly from the first side of the body and a second arm extending outwardly from the second side of the body. The first arm and the second arm each have an outwardly facing surface formed thereon. The mounting cleat is sized and configured so that a portion of the mounting cleat is received between the base member and the first leg and a portion of the mounting cleat is received between the base member and the second leg such that the outwardly facing surface of the first arm engages the inwardly facing surface of the first leg and the outwardly facing surface of the second arm engages the inwardly facing surface of the second leg. The mounting cleat is provided with a means for attaching it to a door, thereby attaching the astragal thereto.

The invention accordingly comprises an article of manufacturer possessing the features, properties, and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings. The reference characters for the second embodiment for similar parts are increased by an increment of 200.

DESCRIPTION OF A PREFERRED EMBODIMENT

Figure 6:
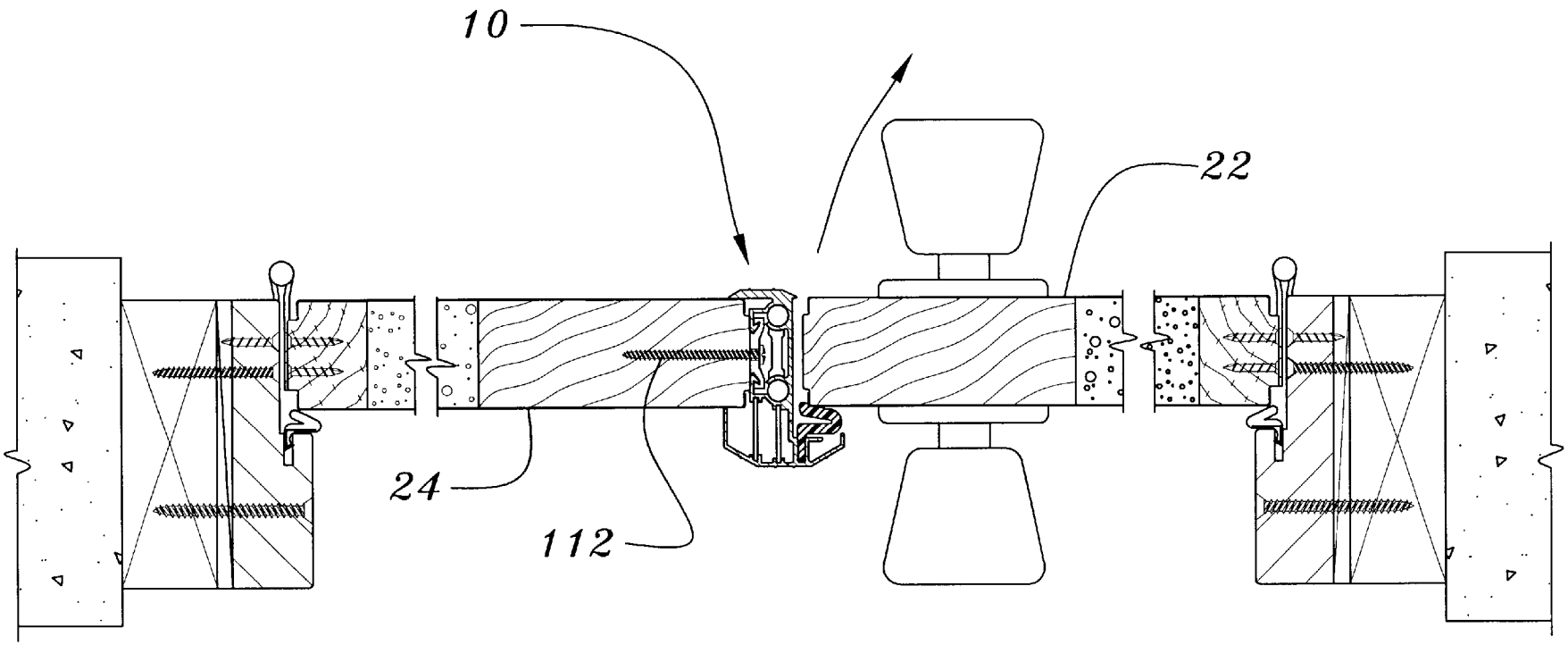
FIG. 6 is a cross-sectional view of the astragal of this invention taken along line 6—6 of FIG. 8, illustrating the astragal installed on a typical metal clad wooden double door assembly.
Figure 7:
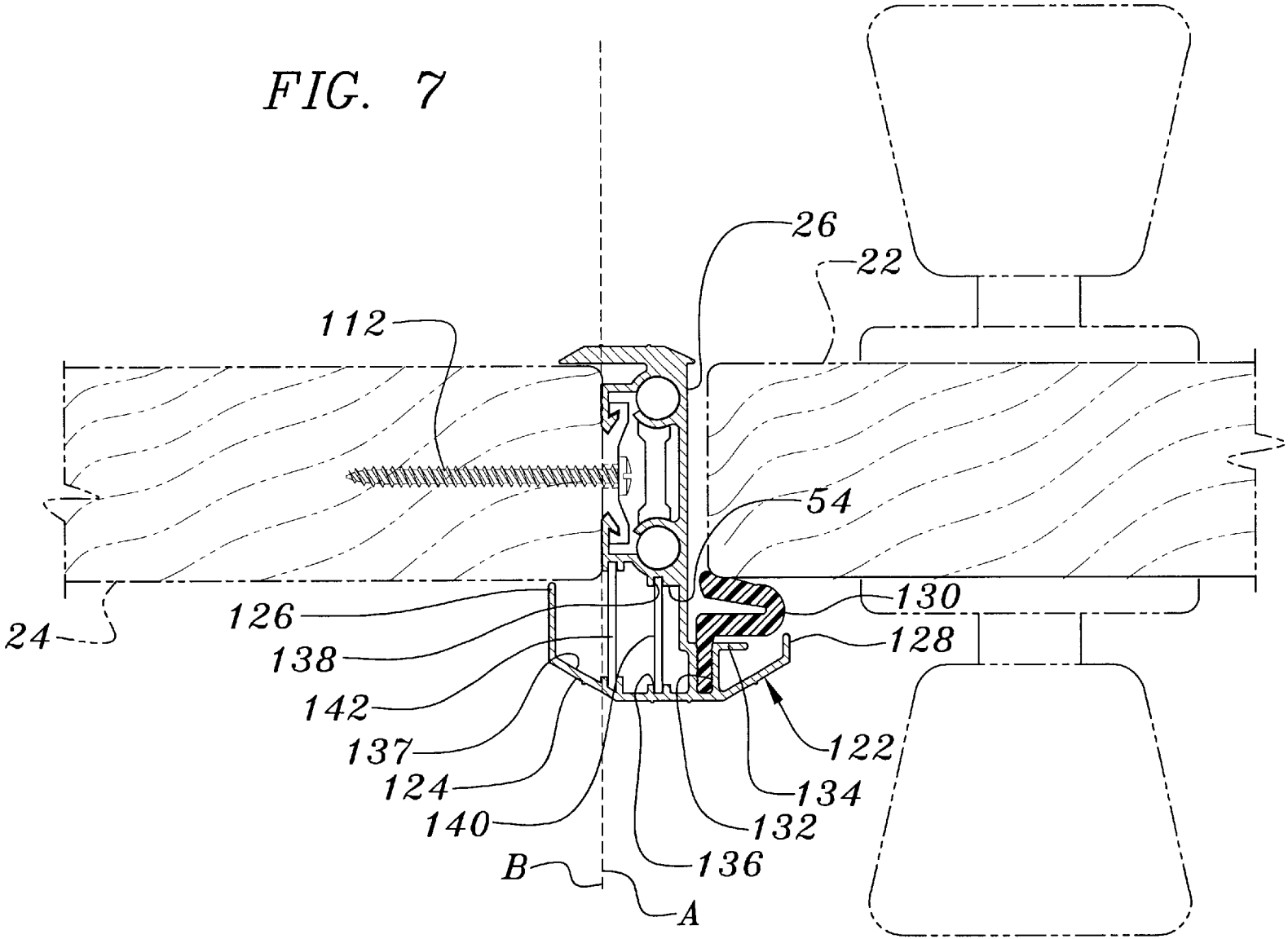
FIG. 7 is detailed view of the astragal of FIG. 6 attached to a typical wooden double door assembly.
Figure 8:
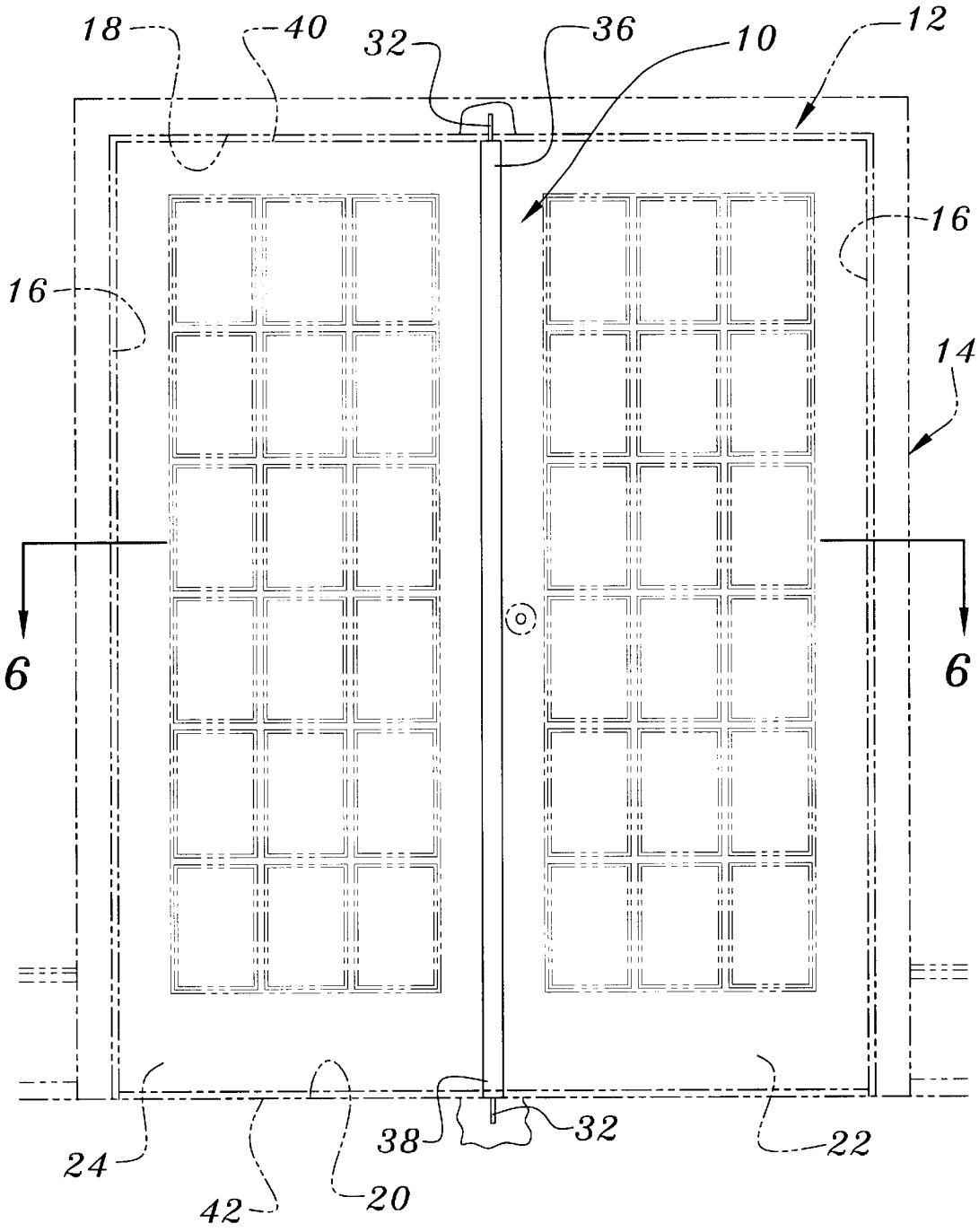
FIG. 8 is a left side elevational view of the astragal of this invention illustrating the installation of the astragal on double doors, which are shown in phantom.

A preferred embodiment for the improved astragal of this invention is illustrated in the drawing FIGS. 1–8 in which the device is generally indicated as 10. Referring first to FIG. 8, it can be seen that the device 10 is installed on a double door assembly 12, shown in phantom. The door assembly 12 comprises a door frame 14 (having opposing door jambs 16 and a header 18), a sill 20, an active door 22, and a generally inactive door 24. In this preferred embodiment, the active door 22 and the generally inactive door 24 swing outwardly in relation to the exterior wall of the structure in which the door assembly is mounted.

Figure 1:
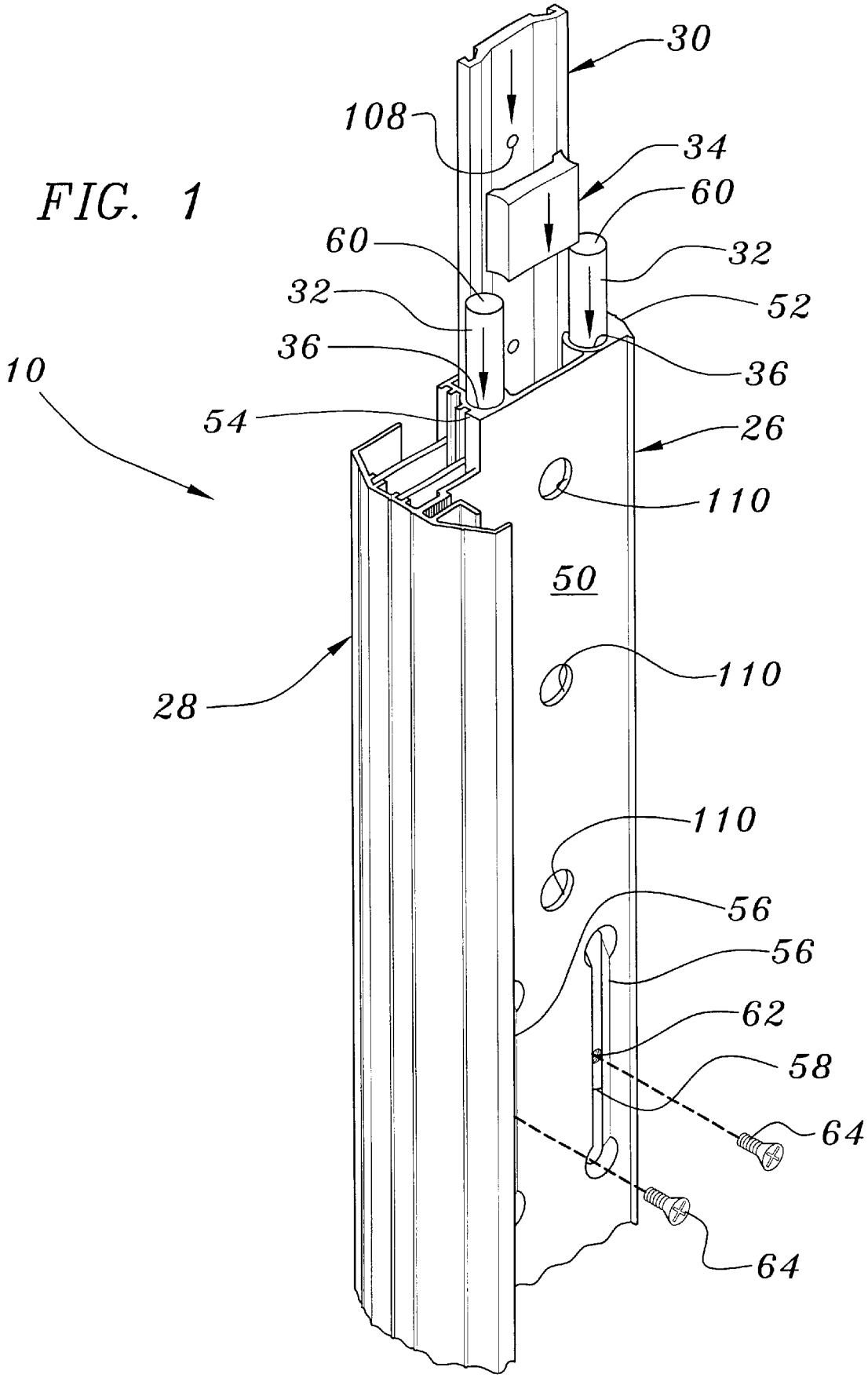
FIG. 1 is an isometric view of the first end of the astragal with the bottom portion broken away, the bolts, cleats and channel support being shown partially inserted at the second end of the base member.
Figure 3:
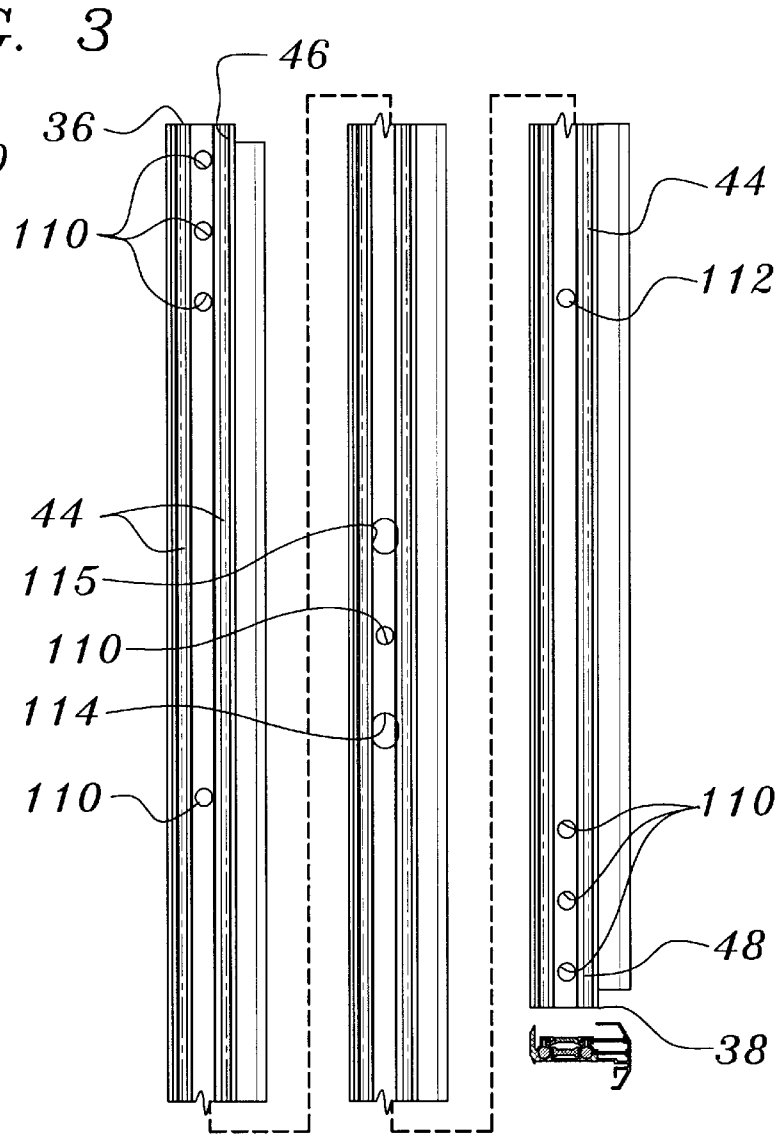
FIG. 3 is a rear elevational view of the astragal of this invention.
Figure 2:
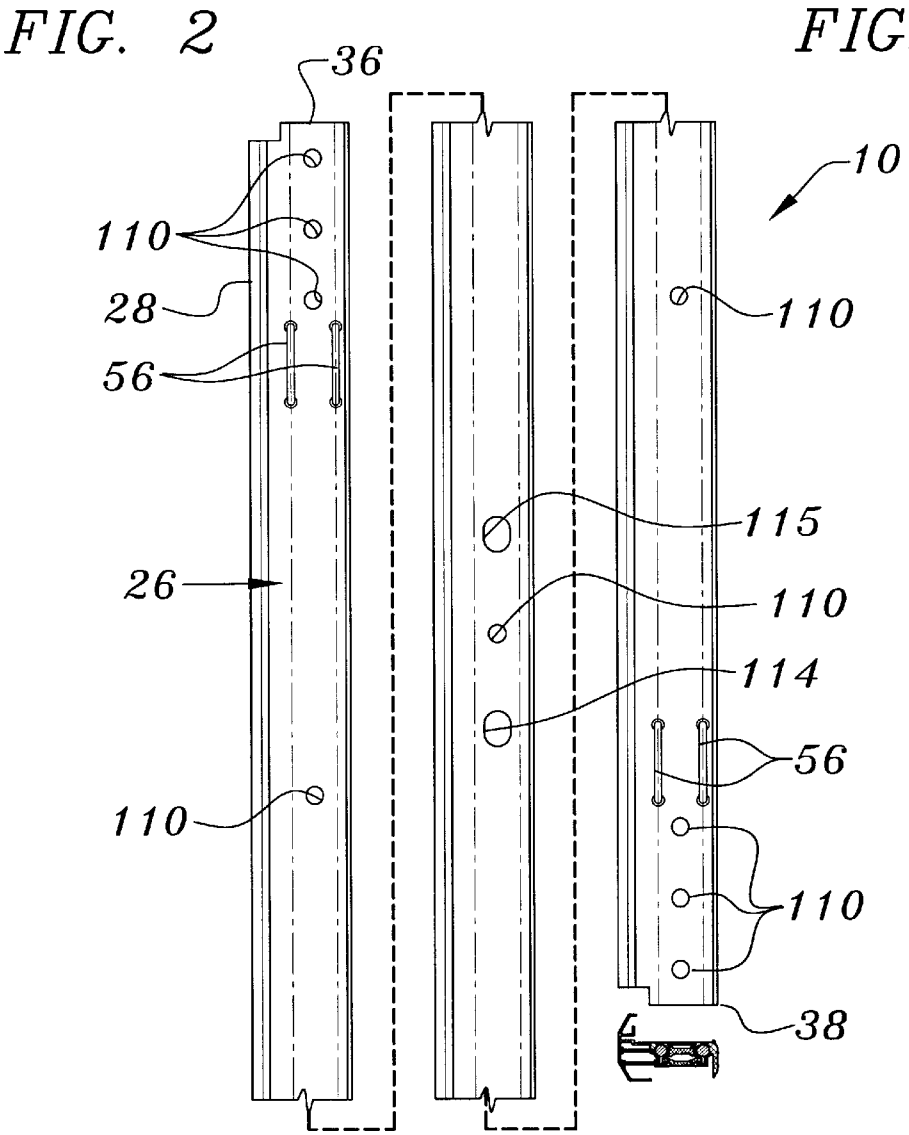
FIG. 2 is a front elevational view of the astragal of this invention.

As can be seen in FIG. 1 and FIG. 2, the astragal 10 comprises a longitudinally extending base member, shown generally as 26, and a longitudinally extending shield member and door stop 28, which in a preferred embodiment are extruded from aluminum as a unitary member. Other suitable materials may be used, particularly steel and high-strength plastics. The astragal further comprises at least one mounting cleat, shown generally as 30, at least one bolt 32 and a channel support, shown generally as 34.

Figure 4:
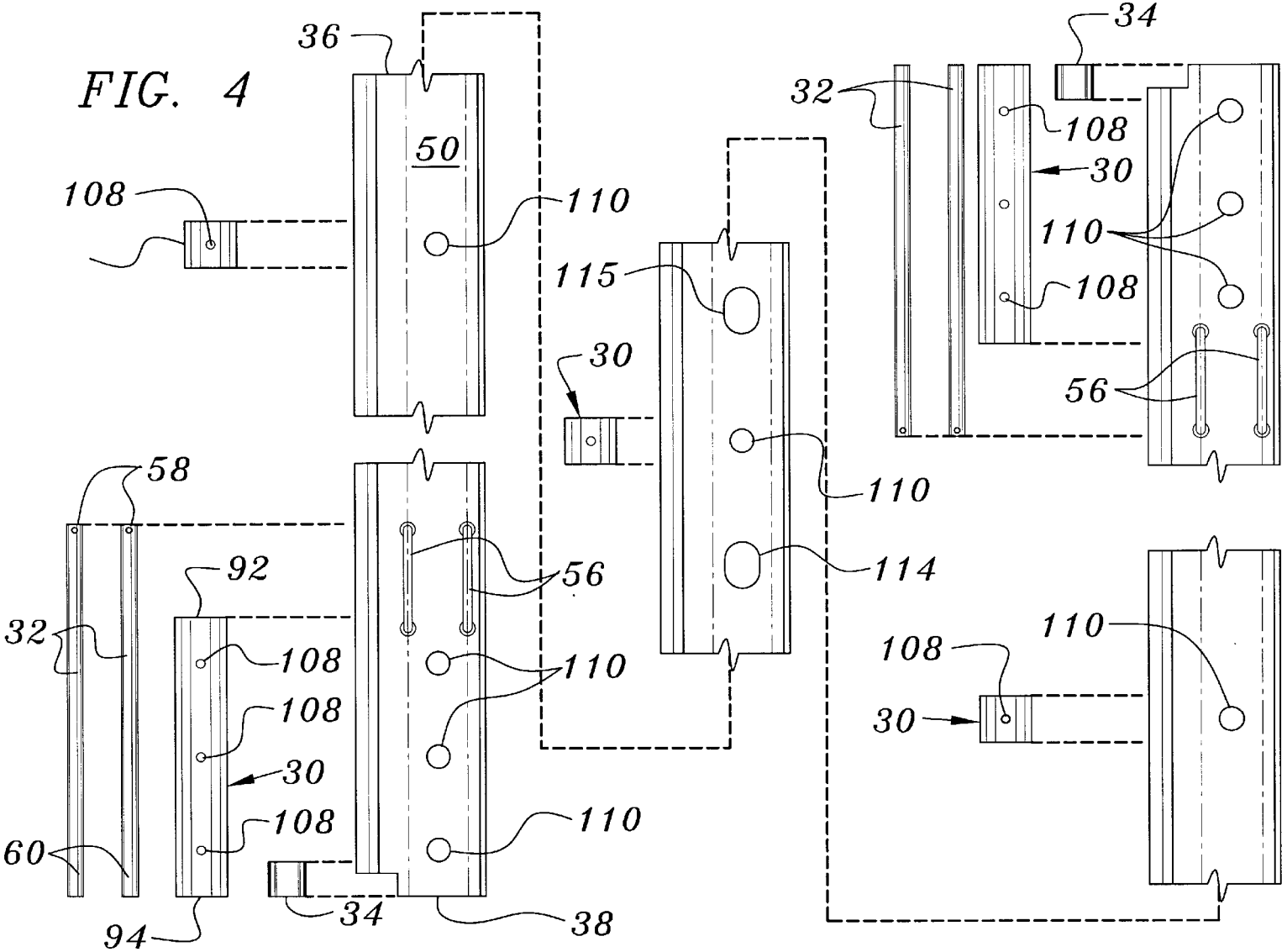
FIG. 4 is a detailed front elevational view of the astragal of this invention illustrating the positioning of the bolts, mounting cleats, and channel supports, with the astragal broken in four places for convenience.

As can be seen most clearly in FIG. 2, the base member 26 has a first end 36 and a second end 38. As seen in FIG. 8, the base member 26 is attached to the generally inactive door 24 so that the first end 36 is proximal to the top 40 of the door 24, and the second end 38 is proximal to the bottom 42 of the door. The base member 26 further comprises at least one longitudinally extending channel 44, and in a preferred embodiment illustrated in the drawing FIGS. 1–8, the base member 26 comprises two parallel channels 44, defined as a first channel 44*a* and a second channel 44*b*. In a second preferred embodiment, illustrated in FIG. 9, the base member 126 comprises a single channel 244. In the preferred embodiment that is illustrated in the drawings, the channels 44*a* and 44*b* extend substantially from the first end 36 to the second end 38 of the base member 26. As the operative portions of the channels 44*a* and 44*b* are proximal to the door header 18 and to the sill 20 is not necessary for the channels to extend for the full-length of the base member 26; however, for ease of manufacture, as the base member is preferably extruded, the channels extend the full-length of base member 26. Each channel, has a first end 46 and a second end 48 that generally coincide respectively with the first end 36 and the second end 38 of the base member 26. At least one bolt 32 is sized and configured to be slidably received in one of the channels 44*a* or 44*b* adjacent to one of the ends 36 and 38 so that the bolt 32 may be selectively movable from an extended position, as shown in FIG. 8, to a retracted position as shown in FIG. 2 and FIG. 4. As seen in the drawings, particularly in FIG. 4, in a preferred embodiment, two bolts 32 are inserted in each channel 44*a* and 44*b*, two bolts 32 are proximal the first end 36 of the base member 26 and two bolts are proximal the second end 38 of the base member 26.

The base member 26 has a front face 50, a first longitudinally extending side 52 and a second longitudinally extending side 54. There are many well-known means for attaching the bolts to the astragal, including slides and pivoting latches, which are suitable for the purpose. However as seen in FIG. 4, in a preferred embodiment, to provide greater strength to the astragal, four longitudinally extending slots 56 are formed through the front face 50 of the base member 26 so that each slot 56 opens into the adjacent channels 44*a* and 44*b*, providing access to each bolt 32. Each bolt 32 has a first end 58 and a second end 60, and the four bolts are inserted within channels 44*a* and 44*b* so that the second end of each bolt is adjacent to the first end 46 or the second end 48 of the channels. Proximal to the first end 58 of the bolt is a threaded hole 62 for receipt of the threaded end of a screw 64, as seen in FIG. 1. Once a screw is inserted through the slot and threadably attached to the hole 62 in the bolt 32, the length of the slot 56 defines the "throw" of the bolt, the length of movement between the retracted position and the extended position. As the bolt is normally maintained at either the fully extended position or the fully retracted position, the slot 56 is countersunk at each end so that when the screw is tightened to lock the bolt in position, the screw head is flush with the front face 50.

Figure 5:
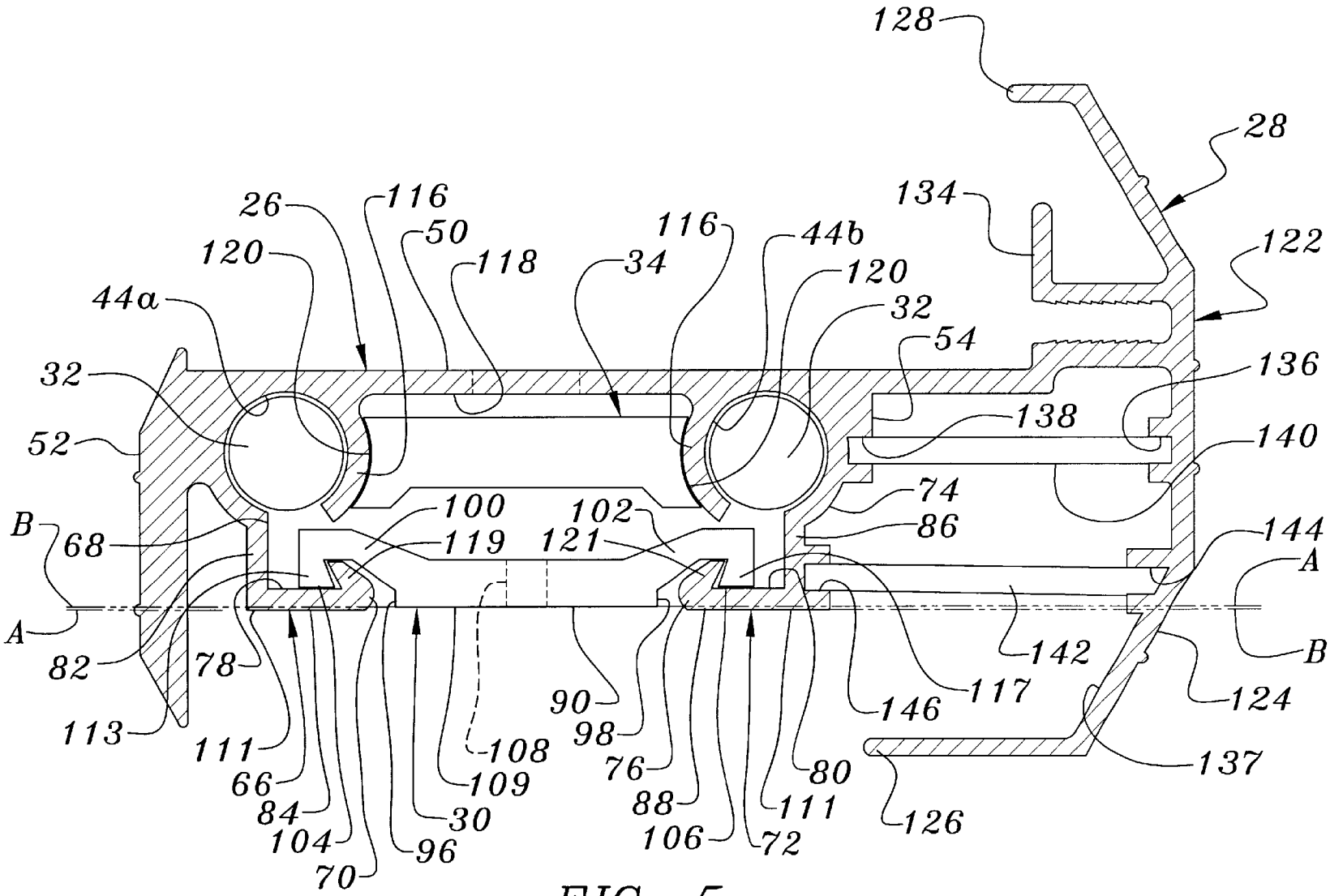
FIG. 5 is a detailed view of FIG. 6, removing the door, screw and seal for convenience.

As seen most clearly in FIG. 5, the astragal 10 further comprises a longitudinally extending first leg 66, having a first end 68 and a second end 70, and a longitudinally extending second leg 72 having a first end 74 and a second end 76. The first end 68 of the first leg 66 is attached to the base member 26 proximal to the first side 52 of the base member 26, and the leg 66 extends outwardly therefrom so that a portion of the first leg, proximal the second end 70 of the first leg, has an inwardly facing surface 78 formed thereon. The first end 74 of the second leg 72 is attached to the base member 26 proximal to the second side 54 of the base member 26, and extends outwardly therefrom so that a portion of the second leg, proximal the second end 76, has an inwardly facing surface 80 formed thereon. The second end 70 of the first leg 66 extends toward the second end 76 of the second leg 72.

The first and second legs 66 and 72 each comprise a first segment and a second segment. The first segment 82 of the first leg 66 includes the first end 68 of the first leg and the second segment 84 includes the second end 70 of the first leg. The first segment 86 of the second leg 72 includes the first end 74 of the second leg and the second segment 88 includes the second end 76 of the second leg. The first segments 82 and 86 extend outwardly from the base member 26 so that the second segments 84 and 88 are spaced apart from the base member 26. The second segments 84 and 88 generally lie in the same plane, which is generally parallel to the front face 50 of the base member 26, and generally extend toward one another. In a preferred embodiment, these legs 66 and 72 are constructed as a unitary part of the extrusion of the base member 26, therefore the legs 66 and 72 extend longitudinally substantially for the length of the base member 26. However, the primary purpose for the legs is to provide a portion of the means for attachment of the astragal 10 to a double door assembly 12, so they would not necessarily have to extend the full length of the astragal, only adjacent to the portions where the astragal is to be attached to the door.

The second portion of the means for attachment of the astragal 10 to a double door assembly 12, is the mounting cleat 30. Each astragal includes at least one longitudinally extending mounting cleat 30, however in a preferred embodiment, as shown in FIG. 4, five separate mounting cleats 30 are provided. Each mounting cleat 30 is constructed in the same form with the exception that their longitudinal lengths vary. FIG. 5 discloses the end view of the mounting cleat 30, which is the same as any cross-section taken at a right angle to its longitudinal axis at any point along its length. As seen in FIG. 4 and FIG. 5, the mounting cleat 30 comprises a body 90 having a first end 92, a second end 94, a first side 96 and a second side 98. The mounting cleat 30 further comprises a first arm 100 and a second arm 102. The first arm 100 extends outwardly from the first side 96 of the body 90 and a second arm 102 extends outwardly from the second side 98 of the body 90. Each arm 100 and 102 has an outwardly facing surface, 104 and 106 respectively, formed thereon. The mounting cleat 30 is sized and configured such that a portion of the mounting cleat 30 is received between the base member 26 and the first leg 66 and a portion of the mounting cleat is received between the base member 26 and the second leg 72. The mounting cleat 30 is received therein such that the outwardly facing surface 104 of the first arm 100 engages the inwardly facing surface 78 of the leg 66 and the outwardly facing surface 106 of the arm 102 engages the inwardly facing surface 80 of the leg 72. Each mounting cleat 30 is attachable to the edge of the door 24, as shown in FIG. 8. For ease of attachment, each mounting cleat 30 has at least one hole 108 formed therethrough for receipt of a screw, bolt, or other suitable attachment means for attaching each mounting cleat to the door 24. For a wood door, as seen in FIG. 7, or a wood core door, as seen in FIG. 6, a wood screw 112 of suitable length would be appropriate. A bolt would be more suitable for a metal frame door.

As seen in FIG. 5, the body of the mounting cleat 30 further comprises a flat surface 109 configured so that a plane A passing through the flat surface 109 lies inwardly of a plane B passing through the outwardly facing surfaces 111 of the second segments 84 and 88 of the respective legs 66 and 72. When the mounting cleat 30 is attached to the door 24, as seen in FIG. 7, and the screw 112 is tightly applied, the flat surface 109 of the mounting cleat will rest against the door edge, and the outwardly facing surfaces 111 of the legs 66 and 72 will also rest against the door edge so that the planes A and B generally coincide. The tightened screw places the arms of the mounting cleat under tension, which increases the resistance to any twisting moment applied to either side of the astragal 10 by bowing of the door under a wind load. In addition, the interlocking flanges on the legs and arms also resist disengagement of the legs from the arms under a twisting or bending moment.

Use of a mounting cleat 30 permits the application of a screw into the center of the door edge so that the screw has the maximum thickness of wood on either side of the screw to prevent breaking out the edges of the wood under shear forces applied to the screw 112. The mounting cleat 30 provides resistance to moment forces that pull the edges of the astragal from the door edge. Attaching the legs of the mounting cleat to the door by screws would accomplish the same purpose, if it were not for the fact that the screws would be very close to the surface of the door and would be only covered by a thin layer of wood, which would fail under the shear forces.

To maintain the mounting cleat 30 in its proper position, and to reduce the chance that the cleat 30 becomes disengaged from the arms 100 and 102 when under stress, the arms 100 and 102 of the mounting cleat 30 are angled inwardly with arm 100 ending in an outwardly facing arm flange 113 and arm 102 ending in an outwardly facing arm flange 117. Arm flange 113 having the outwardly facing surface 104 formed thereon and arm flange 117 having the outwardly facing surface 106 formed thereon. The arm flange 113 and arm flange 117 each being angled toward the body 90 of the mounting cleat 30. The second end 70 of leg 66 has an inwardly facing leg flange 119 formed thereon and second end 76 of leg 72 has an inwardly facing leg flange 121 formed thereon. The leg flanges being angled toward the first segment of the respective leg. Arm flange 113 engages leg flange 119 and arm flange 117 engages leg flange 121, such that the angular relationship of the flanges resists separation of the parts when a twisting moment is applied to the astragal 10. The mounting cleat 30 is held in place longitudinally by a friction fit.

As discussed previously, in a preferred embodiment, there are five separate mounting cleats as shown in FIG. 4. The number of attachment points, requiring a mounting cleat, is determined by the strength rating of the astragal. The mounting cleats 30 are inserted within the base member 26 and attached by screws at the points of greatest stress. A longer mounting cleat 30 is positioned proximal to both the first end 36 and the second end 38 of the base member 26, so that the cleats 30 are adjacent to the bolts 32. The longer mounting cleats 30 each have three holes 108 for attachment to a door by the screws 112. Shorter cleats 30, having one hole 108 for attachment of the screw 112, are positioned along the longitudinal length of the base member 26 as shown in FIG. 4. The holes 108 through the cleats are aligned with holes 110 through the base member 26. The holes 110 provide access through the base member 26 of the astragal 10 to the screws 112. The head and shank of a screw 112 is inserted through each hole 110 in the base member; but only the shank of the screw extends through the corresponding hole 108 in the mounting cleat 30 so that the screws 112 attach the mounting cleats 30 to the door 24, as seen in FIG. 7. Certainly, in other embodiments additional cleats may be added to increase the strength of the astragal 10 or savings may be achieved by reducing the number of cleats utilized. However, sufficient attachment points should be strategically placed so that failure will occur in the door itself before failure of the astragal 10.

Double doors will normally have a dead bolt (not shown) and a door knob latch (not shown), attached to the free door 22, which are extendable into a dead bolt retainer (not shown) and a latch retainer (not shown) mounted in the opposing door 24. The base member 26 has two holes 114 and 115 therethrough for passage of the latch and dead bolt respectively.

As seen in FIG. 5 and FIG. 7 the channels 44*a* and 44*b* are each comprised of a wall 116, that extends outwardly from the rear face 118 of the base member 26 and oppose one another. In a preferred embodiment, due to the method of extrusion, the channels are usually open so that the walls of the channels are not continuous. At the point of insertion of the bolts 32, the stress will be greatest on the channels 44*a* and 44*b* and the walls 116 may be twisted open by the forces placed on the bolts 32, when high winds strike the double door assembly 12. At this point of greatest stress, a channel support 34, having a pair of opposing sides 120, is frictionally inserted between the walls 1 16 so that each of the opposing sides 120 of the support 34 engage a corresponding one of the walls 116, thereby reinforcing them. In the preferred embodiment illustrated in FIG. 5 the bolts and the channels are cylindrical, thus the opposing sides 120 of the channel support may be arcuate so that the curvature matches the curvature of the walls 116. In other embodiments, the bolts may have a plurality of longitudinal sides with the channels having a corresponding cross-section.

The astragal 10 further comprises a longitudinally extending shield member and door stop 122 that is attached to the base member 26 so that the shield member and door stop 122 extends laterally therefrom at generally a right angle to the front face 50 of the base member 26. The shield member and door stop 122 extends longitudinally substantially for the length of the base member 26. As shown in FIG. 7, this shield member and door stop 122 comprises a generally C-shaped element 124 having a first edge 126 that is adjacent to the door 24 and a second edge 128 that is spaced apart from the door 22, when the door 22 is closed. A longitudinally extending seal 130 is inserted in a standard and well-known fashion within a retaining slot 132. The seal 132 and the projection 134 act as a door stop, preventing the door 22 from swinging past alignment with door 24 when closed. To provide additional strength to the shield member and door stop 122, at least one longitudinal slot 136 is formed on the interior face 137 of the element 124, and an opposing slot 138 is formed on the second side 54 of the base member 26 so that a longitudinally extending plate 140 may be inserted and retained between the slots. Plate 140 may extend the full-length of the shield member and doorstop 122 or in a preferred embodiment, to reduce weight and costs, the plate 140 may be inserted in areas having significant bending moment, for example proximal the midpoint of the astragal 10. Additional plates may be inserted adjacent the bolts 32. The length of these plates will be determined by those skilled in the art based upon the particular strength of the doors being used, that is, the more flexible the doors the greater length of the plates that will be required. For added strength a second longitudinally extending plate 142 may be inserted in a second slot 144 in the interior face 138 of the element and simultaneously in an opposing slot 146 formed in the second leg 72. Again, the length and longitudinal location of the plates for the second plate 142 will be determined by the added strength necessary for the astragal 10, based upon the selection of door material and door construction, to obtain the rating level/strength required.

As previously discussed, the unitary base member and shield member and door stop will be extruded from aluminum. The cleats, channel support and plates may be constructed from steel or aluminum and the bolts are preferably constructed from steel. The seal 130 is well know to those skilled in the art and is made from appropriate flexible material, including plastics and rubber.

Figure 9:
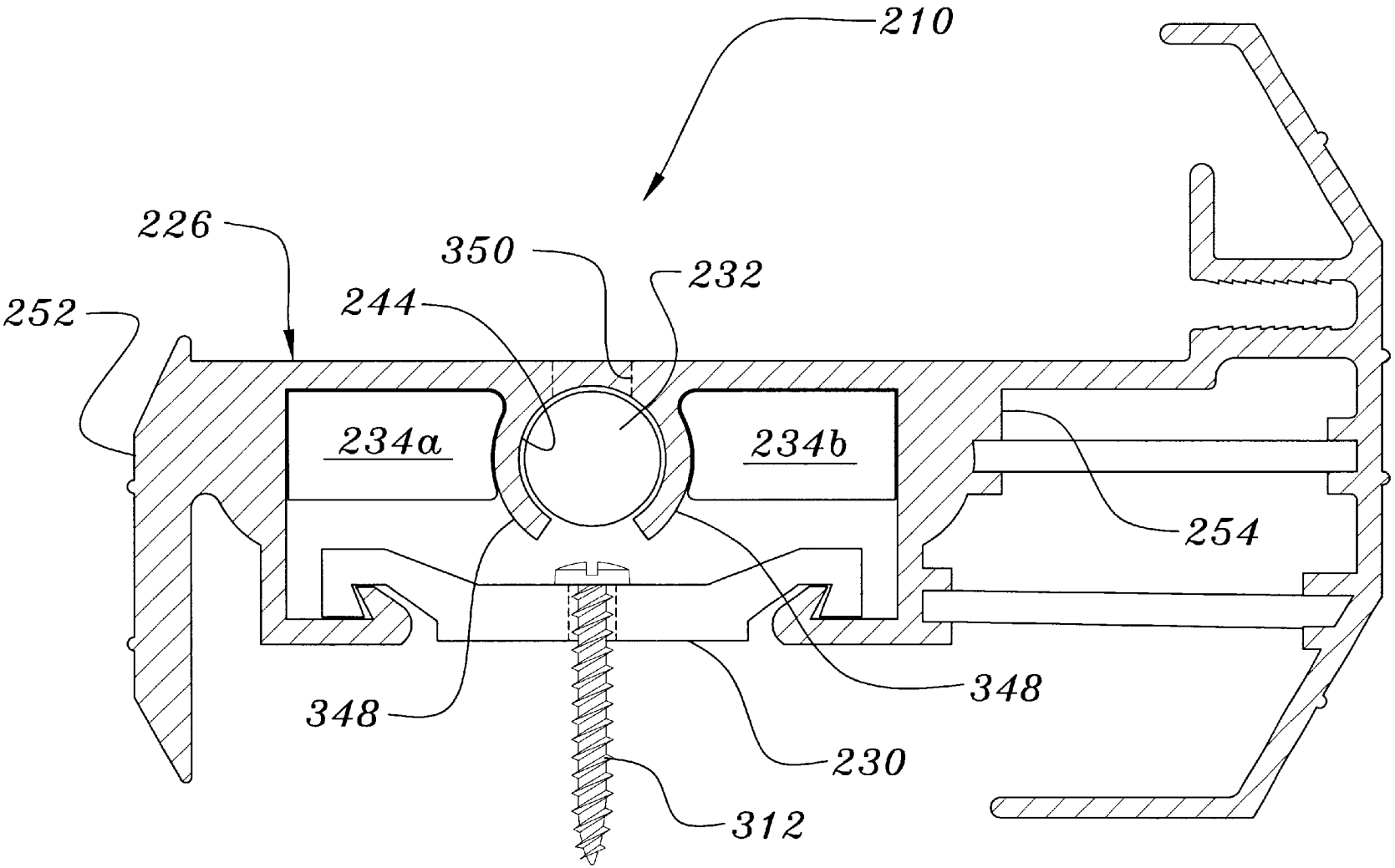
FIG. 9 is a cross-sectional view of a second embodiment of the invention of FIG. 1 illustrating a single channel.

FIG. 9 illustrates a second embodiment of the astragal 10 which is indicated as 210, and all reference characters for similar parts will be increased by an increment of 200. As can be seen in FIG. 9, the astragal 210 has a single channel 244 that is centered between the first side 252 and the second side 254 of the base member 226. The remainder of the structure, including the mounting cleat 230 is very similar to the structure of the astragal 10. One difference is that the the channel support 34 now comprises two parts 234*a* and 234*b* installed on opposite sides of the channel 244 to strengthen the channel walls 348 adjacent to the bolt 232. In addition, astragal 210 will have to be mounted to the door edge prior to insertion and attachment of the bolts 232 into the channel 244, as the attaching screw 312 will have to be inserted through a hole 350 formed through the base member 226.

Having thus set forth preferred constructions for the current invention, it is to be remembered that these are but two preferred embodiments. Attention is now invited to a description of the use of the astragal 10, as use of astragal 210 will be generally the same. The local and state code requirements dictate the rating that the double doors must meet; however, the double doors may certainly be constructed to obtain a rating higher than the minimum required. The current invention is capable of obtaining high hurricane ratings with a lighter structure and at a much reduced cost over prior art astragals that are constructed from heavier materials to meet the required standards. The dimensions of the various components of the astragal 10 will depend on the rating to be obtained. Certainly the size of the door will affect the rating obtained on any particular construction of the double doors. In one preferred embodiment, as seen in FIG. 4, for a typical 6 foot 8 inch astragal, the bolts will be 8 inches long, the longer cleats will be 6 inches long, the shorter cleats will be 1 inch long, the plates will be 4 inches long and the channel support will be less than 1 inch long. These dimensions may be adjusted by those skilled in the art, and the remaining dimensions of the astragal may be adjusted as necessary for attachment to any door shape, style or size, as such adjustments in dimensions will be obvious to those skilled in the art.

The location of the dead bolt and latch for the door knob will be determined by the openings 115 and 114 respectively, and the dead bolt and latch will be installed prior to the installation of the astragal 10. The astragal will be attached to a double door assembly with the bolts installed in the channels 44 and held there by screws 64. The cleats 30, the channel supports, the plate 142 and the second plate 144, are mounted in the appropriate positions in the extruded portion of the astragal 10 and held there by a friction fit or by glue, as necessary. Having all the parts in place prior to installation will make the installation easier for the installer. The installer inserts the seal 130 into the retaining slot 132 and then mounts the astragal 10 over the latch and the dead bolt retaining holes (not shown) so that the latch and dead bolt may freely pass through the base member 26 and into their respective retaining holes (not shown) in the door 24. Screws 112 are then inserted through each hole 110 in the base unit 26 so that the threaded portion of the screws pass through the respective holes 108 in the cleats 30. When the cleats 30 are completely tightened, the flat surface 109 of the body 90 of each cleat 30 will rest against the door edge and the surface 111 of each leg 66 and 72 will also rest against the door edge. The pressure of the cleats against the legs significantly increases the resistance of the astragal to failure due to wind or other forces applying a rocking motion to the astragal due to inward and outward pressures alternatively applied to the doors. These pressures also cause the door to bow inwardly and outwardly applying forces on the bolts. With two bolts, one adjacent to each of the opposing sides of the door to which the astragal 10 is attached, the bolts are able to withstand much greater forces than astragals that have only one bolt.

While the foregoing describes a particularly preferred embodiment of the present invention, it is to be understood that numerous variations and modifications of the structure will occur to those skilled in the art. Accordingly, the foregoing description is to be considered illustrative only of the principles of this invention and is not to be considered limitative thereof, the scope of the invention being determined solely by the claims appended hereto.

What is claimed is:

1. An astragal for use with a double door assembly that includes an active door and a generally inactive door, each being pivotally mounted to a door frame and mounted over a sill such that their vertical edges are adjacent one another and the doors overlie the sill when the doors are closed, said astragal comprising:

a longitudinally extending base member having a first end and a second end, a first side and a second side, a front face and a rear face and at least one longitudinally extending channel formed therein, said channel having a first end and a second end;

at least one bolt slidably inserted in said channel adjacent one of said first and second ends of said channel, said bolt being selectively movable between an extended position and a retracted position, whereby a generally inactive door is secured or released respectively;

means for locking said bolt in said channel;

a first leg having a first end attached to said base member proximal said first side thereof and a second end extending outwardly therefrom such that a portion of said leg proximal said second end has an inwardly facing surface;

a second leg having a first end attached to said base member proximal said second side thereof and a second end extending outwardly therefrom such that a portion of said leg proximal said second end has an inwardly facing surface, and said second ends of said first and second legs extend toward one another; and at least one longitudinally extending mounting cleat, said cleat comprising a body having a first end, a second end, a first side and a second side, a first arm extending outwardly proximal said first side of said body, said first arm having an outwardly facing surface formed thereon and a second arm extending outwardly proximal said second side of said body having an outwardly facing surface formed thereon, said cleat being sized and configured such that a portion of said cleat is received between said base member and said first leg and a portion of said cleat is received between said base member and said second leg such that said outwardly facing surface of said first arm engages said inwardly facing surface of said first leg and said outwardly facing surface of said second arm engages said inwardly facing surface of said second leg, said cleat being attachable to a door edge, so that said base is attachable to the door.

2. An astragal as in claim 1, wherein said first arm and said second arm of said cleat extend inwardly toward said base member, each said arm ending in an outwardly extending arm flange, said arm flanges being angled toward said body of said cleat, said second end of each said leg having an inwardly facing leg flange thereon, and each said leg flange being angled toward said first segment of said leg to which said leg flange is attached, such that each said leg flange engages a corresponding one of said arm flanges.

3. An astragal as in claim 1, wherein said base member comprises a pair of longitudinally extending channels, defining first and second channels, said first and second channels being spaced apart from one another and each said first and second channels slidably receiving at least one bolt therein proximal one of said first and second ends of said base member.

4. An astragal as in claim 3, wherein said first channel of said pair of channels comprises a wall extending outwardly from said rear face of said base member and said second channel of said pair of channels comprises a wall extending outwardly from said rear face of said base member, said wall of said first channel and said wall of said second channel opposing one another, at least one channel support having a pair of opposing sides, said channel support being inserted between said first channel and said second channels such that one side of said support engages the wall of said first channel and the other side of said pair of opposing sides engages the wall of said second channel, said channel support lying adjacent said portion of said channels having bolts inserted therein such that each one of said opposing sides engage a corresponding one of said walls.

5. An astragal as in claim 1, wherein said astragal further comprises a longitudinally extending shield member and door stop being attached to said base member such that said shield member and door stop extends laterally therefrom at generally a right angle to said base member and extends longitudinally substantially for the length of said base member.

6. An astragal as in claim 5, wherein said shield further comprises an interior face having a longitudinal slot formed therein, and said base member having a longitudinally extending first slot formed therein opposing said first slot in said shield, a first longitudinally extending plate having opposing edges, one of said edges being received in said first slot in said shield and the other one of said opposing edges being received in said first slot in said base member.

7. An astragal as in claim 6, wherein said shield further comprises a second longitudinal slot formed in said interior face, and said base member having a second longitudinally extending slot formed therein opposing said second slot in said shield, a second longitudinally extending plate having opposing edges, one of said edges being received in said second slot in said shield and the other one of said opposing edges being received in said second slot in said base member.

8. An astragal as in claim 1, wherein said body of said cleat has a flat surface thereon and said first and second legs each have an outwardly facing surface thereon, said outwardly facing surfaces lying in the same plane that is generally parallel to and spaced apart from a plane passing though said flat surface of said body, said plane passing though said flat surface of said body lying inwardly of said plane passing through said outwardly facing surfaces of said legs, whereby when said body of said cleat is attached by an attaching means to a door the outwardly facing surfaces of said second segments engage the door edge and when attached tightly said surface of said body also engages the door edge placing said arms under tension.

9. An astragal for use with a double door assembly that includes an active door and a generally inactive door, each being pivotally mounted to a door frame and mounted over a sill such that one of the vertical edges of each door are adjacent one another when the doors are closed and overlie the sill, said astragal comprising:

a longitudinally extending base member having a first end and a second end, a first side and a second side, a front face and a rear face and a pair of channels, each channel of said pair of channels being contiguously formed with said rear face such that one channel of said pair of channels is formed proximal said first side and the other channel of said pair of channels is formed proximal said second side, each said channel of said pair of channels having a first end and a second end;

at least one-bolt slidably inserted in each channel of said pair of channels adjacent one of said first and second ends of each said channel, said bolt being selectively movable between an extended position and a retracted position, whereby a generally inactive door is secured or released respectively;

means for locking said bolt in said channel; and means for attaching said base member to a door edge.

* * * * *